United States Patent [19]

Sasaki

[11] 4,384,036

[45] May 17, 1983

[54] PROCESS FOR PRODUCING LIQUID DEVELOPER FOR ELECTROSTATIC PHOTOGRAPHY USING SELECTED SOLVENTS

[75] Inventor: Jun Sasaki, Asaka, Japan

[73] Assignee: Fuji Photo Film Co., Ltd., Kanagawa, Japan

[21] Appl. No.: 300,098

[22] Filed: Sep. 8, 1981

[30] Foreign Application Priority Data

Sep. 8, 1980 [JP] Japan ..... 55-1243356

[51] Int. Cl.[3] ..... G03G 9/12

[52] U.S. Cl. ..... 430/113; 430/114; 430/137; 430/904

[58] Field of Search ..... 430/137, 113, 114

[56] References Cited

U.S. PATENT DOCUMENTS 3,971,659 7/1976 Sato et al. ..... 430/77 X

*Primary Examiner*—John D. Welsh

*Attorney, Agent, or Firm*—Sughrue, Mion, Zinn, Macpeak and Seas

[57] ABSTRACT

A process for producing a liquid developer for electrostatic photography is disclosed. In the process, a dispersion of fine polymer particles in a non-polar solvent is mixed with a dye that is insoluble in said non-polar solvent and which is soluble in the monomer which is at least one component of the polymer. The polymer particles are then colored by removing from the dispersion a second solvent which dissolves the dye, is miscible with the non-polar solvent and which is capable of swelling at least part of the polymer in such a manner that said second solvent is present in said dye-containing polymer dispersion while the removal is continued.

12 Claims, No Drawings

PROCESS FOR PRODUCING LIQUID DEVELOPER FOR ELECTROSTATIC PHOTOGRAPHY USING SELECTED SOLVENTS

FIELD OF THE INVENTION

This invention relates to a process for producing a liquid developer for electrostatic photography, and more particularly, to a process for producing a liquid developer for electrostatic photography using toner particles that are obtained by coloring the fine polymer particles prepared by, say, polymerization granulation.

BACKGROUND OF THE INVENTION

Conventional liquid developers for electrostatic photography are produced by forming a dispersion of a resin and a dye or pigment in a non-polar solvent, e.g., an aliphatic hydrocarbon and agitating it with a ball mill or high-speed stirrer. The liquid developer thus-produced has low dispersion stability and storage stability. Therefore, with the passage of time the toner particles are precipitated to reduce the characteristics of the developer. An attempt has been made to add a large amount of dispersion stabilizer to improve the stability of the dispersion. However, this process decreases the resistance of the liquid developer and thus fails to produce a liquid developer having good properties.

U.S. Pat. No. 3,990,980 describes a developer that is designated a second liquid toner and which is prepared by the "polymerization granulation process". According to this process, a substance which dissolves in a non-polar solvent when it is a monomer and which does not dissolve in the solvent when it becomes a polymer is dissolved in the non-polar solvent together with a polymerization initiator, and the monomer in solution is polymerized to form a liquid developer having the resin particles dispersed in the solvent. The developer obtained by this method is known to have good dispersion stability and storage stability.

A method for producing colored toner particles using this polymerization granulation process is described in Japanese Patent Application (OPI) No. 52588/78 (the symbol (OPI) as used herein means an unexamined published Japanese patent application). According to this method, there is prepared a solution which contains a monomer which is soluble in a non-polar solvent when it is a monomer and which becomes insoluble when it is a polymer, a dye which is soluble in the monomer but insoluble in the non-polar solvent, and a polymerization initiator. Polymerization is effected by adding the solution dropwise into a non-polar solvent containing, say, a charge regulator. In this method, as soon as the solution is added dropwise to the non-polar solvent, the monomer starts to dissolve in the solvent to thereby form fine crystals of the dye before the monomer is polymerized. The resulting liquid developer for electrostatic photography is such that the polymer particles are adsorbed on the fine dye crystals.

However, our experimental studies have revealed that the process of Japanese Patent Application (OPI) No. 52588/78 has several problems. For one thing, many dyes have such a chemical structure that a radical can remain stable, for example, phenolic hydroxyl group, phenylamino group or nitrophenyl group, and as suggested by the fact that many of the dyes having such a structure are used as a radical-polymerization inhibitor, they operate as a substance which retards the radical polymerization of monomers. Therefore, as in the process described above, if the radical polymerization of the monomer is performed in the presence of a dye, no satisfactory polymerization is achieved, and in an extreme case, no polymer particles are deposited on the surface of the fine dye crystals. Hence, the dye that can be used in this process should not work as an inhibitor of radical polymerization. Furthermore, as indicated above, the dye must be insoluble in the non-polar solvent and soluble in the monomer to be polymerized. This means the latitude in selection of applicable dyes and monomers is very small, and in practice, many dyes cannot be used in this process.

SUMMARY OF THE INVENTION

We have made various studies to eliminate the problems of the conventional processes for producing a liquid developer for electrostatic photography. In our studies, it has been found that polymer particles formed and dispersed in a non-polar solvent by polymerization is colored by adding to the polymer particle dispersion a monomer constituting the polymer particles and a dye which is insoluble in the non-polar solvent and soluble in the monomer and subsequently removing the monomer by vacuum-drawing or heating the dispersion. We assume that this result was achieved by the following mechanism: when the monomer and dye were added to the dispersion, the solubility of the dye in the monomer decreased and the dye was distributed to the polymer particles. By the subsequent vacuum drawing or heating to remove the monomer, the dye was completely impregnated in or deposited on the polymer particles. We further speculate that the liquid monomer not only acted as a solvent for the dye but that it also had the ability to swell the polymer to facilitate impregnation with the dye. Based on this speculation, we have discovered that the same result can be obtained by replacing the monomer with another organic solvent having these two functions such as ethanol, acetone or ethyl acetate. We have also found that the monomer need not always be added to the non-polar solvent together with the dye and that the desired effect is attained by adding only a dye powder if there is a monomer remaining after polymer particles have been formed in the non-polar solvent by the polymerization granulation process.

Therefore, one object of this invention is to provide a process for producing a liquid developer for electrostatic photography having improved dispersion stability and storage stability.

Another object of this invention is to provide a process for producing a liquid developer for electrostatic photography that uses toner particles that are obtained by coloring the fine polymer particles prepared by, say, the polymerization granulation process.

These objects can be achieved by a process for producing a liquid developer for electrostatic photography which comprises adding a dye in a dispersion of fine polymer particles in a non-polar solvent, said dye being insoluble in the non-polar solvent and soluble in a monomer which is at least one component of the polymer, and coloring the polymer particles by removing from the dispersion, a solvent (hereinafter referred to as "second solvent") which dissolves the dye, is miscible with the non-polar solvent and is capable of swelling at least part of the polymer, in the presence of the second solvent in the dye-containing polymer dispersion.

DETAILED DESCRIPTION OF THE INVENTION

The polymer particle dispersions used in the process of this invention are prepared by a method which is basically identical to the polymerization granulation method. To be specific, a solution containing a polymerization initiator and a monomer which is soluble in a non-polar solvent but which becomes insoluble when it is a polymer is added dropwise to, for example, a non-polar solvent that has been heated under stirring. By this procedure, a dispersion of fine polymer particles in the non-polar solvent is obtained. Before or after the polymerization, a resin that works as, for example, charge regulator, and which is soluble in the non-polar solvent may be dissolved in that solvent.

The non-polar solvent may be comprised of any material used as a liquid carrier in a liquid developer for electrostatic photography. Typical examples are aliphatic hydrocarbons such as Isopar H, L, and K commercially available from Esso S.A.F. Illustrative aliphatic hydrocarbons include isooctane, n-nonane, isononane, n-decane, isodecane, n-undecane, isoundecane, n-dodecane, isododecane, n-tridecane, isotridecane, n-tetradecane, isotetradecane and mixtures thereof.

The polymerizable monomer may be any type that is soluble in the liquid carrier used as non-polar solvent and which becomes insoluble in the carrier when it is a polymer. Examples are acrylic or methacrylic acid esters of lower alkyls (e.g., methyl or ethyl), vinyl acetate, styrene and ethylene.

The polymerization initiator may be of a conventional type such as azobisisobutyronitrile.

As mentioned above, a resin soluble in the non-polar solvent may be optionally added to the polymer dispersion used in the process of this invention. Examples of such resin include an alkyd resin modified with linseed oil, homopolymers or copolymers of methacrylic or acrylic acid esters of higher alkyls (e.g., lauryl, dodecyl, octyl and 2-ethylhexyl), copolymers thereof with hydroxymethacrylate, dimethyl aminomethacrylate or glycidyl methacrylate, and styrene-butadiene copolymer.

The polymer dispersion used in the process of this invention can be prepared by the polymerization granulation method described in, for example, *Dispersion Polymerization in Organic Media*, edited by K. E. J. Barrett, John Willen and Sons, London, 1974, British Pat. Nos. 1,199,651, 1,206,398, 893,429, 934,038, and U.S. Pat. No. 3,637,569.

A dye is added to the polymer dispersion thus-produced. The dye is insoluble in the non-polar solvent for the dispersion and soluble in the monomer that is at least one component of said polymer. A second solvent that dissolves said dye, is miscible with the non-polar solvent and which is capable of swelling at least part of said polymer is added, unless the second solvent is present in the polymer dispersion. The second solvent is then removed from the dispersion to thereby provide colored polymer particles.

Any dye can be added to the polymer dispersion so long as it is insoluble in the non-polar solvent and soluble in the monomer which is at least one component of the polymer. Examples of such dyes include Hansa Yellow, Martius Yellow, Crystal Violet, Victoria Blue, Malachite Green, Chrome Fast Red, Celliton Fast Red, Para Red, Dinitroaniline Orange, Disperse Yellow, Disperse Red, Disperse Blue, Solvent Red, Sumikaron Rubine S-2GL, Sumikaron Rubine SE-GL, and Sumikaron Brilliant Red SE-BL (the last three dyes are available from Suminoto Chemical Co., Ltd.). One characteristic feature of this invention is that the dye is added after polymer particles are produced. Unlike the method of Japanese Patent Application (OPI) No. 52588/78 wherein the dye is added before polymer particles are produced, the process of this invention is free from the risk of inhibition of polymerization by the dye, and permits the use of a great number of dyes.

The second solvent that dissolves the dye, is miscible with the non-polar solvent and is capable of swelling at least part of the polymer is preferably a monomer that is the same as a monomer used as at least one component of the polymer. One advantage of using such a monomer is that it does not cause dissolution or agglomeration of the polymer particles which occur in the presence of other solvents. Alternatively, a solvent such as ethanol, acetone or ethyl acetate that meets the three requirements for the second solvent can also be used by controlling, for instance, its amount. The second solvent need not be added to the polymer dispersion if it contains a sufficient amount of monomer left unpolymerized when the polymer particles were formed by the polymerization granulation method. However, the weight ratio of the second solvent to the polymer in the polymer dispersion is at least 1:10, and if the ratio of the residual monomer is below this value, the second solvent must be added to the polymer dispersion. The second solvent may be added to the polymer dispersion in the form of a solution of the dye in the second solvent. Alternatively, the dye may be added to the dispersion as a powder, and the second solvent may be added either before or after the addition of the dye. In any event, the only requirement is that the polymer dispersion contains the dye and the second solvent when the second solvent is removed in the subsequent step. However, the addition of the dye and the second solvent need not be completed before the subsequent stage of removing the second solvent, and the second solvent may be removed from the polymer dispersion as an additional dye and/or second solvent is supplied.

The weight ratio of the non-polar solvent to the polymer particles is in the range of from 99:1 to 50:50, preferably from 90:10 to 70:30. The dye may be present in an amount of at least 0.5 wt% of the polymer in the polymer dispersion, and for providing good color density, at least 3 wt% of the dye is preferably used. The amount of the second solvent is from a tenth of to ten times the weight of the polymer in the polymer dispersion. In order to achieve easy removal of the solvent by vacuum drawing in the subsequent stage, the volume of the solvent is preferably not more than a third of the volume of the polymer dispersion. However, it should be noted that the proportions of the respective components are not limited to the above-specified ranges since the optimum ratio varies with the type of the dye, polymer, non-polar solvent and second solvent used and it may be outside the specified ranges.

The second solvent is removed from the polymer dispersion as it is added dropwise to the dispersion together with the dye under stirring or after their addition has been finished. To remove the second solvent from the polymer dispersion which has been blended with the dye and the second solvent, vacuum is drawn from the dispersion or the dispersion is heated under vacuum. The pressure and temperature conditions are generally not more than 50 mmHg and at least 40° C., preferably from 30 to 50 mmHg and from 40° to 90° C., respectively. The temperature of from 40° to 70° C. is particularly preferred for the purpose.

Upon addition of the dye and second solvent to the polymer dispersion, the solubility of the dye is decreased and an increasing amount of the dye is distributed to the polymer particles. By subsequent removal of the second solvent from the dispersion by vacuum drawing or heating, the dye is completely impregnated in or adsorbed on the polymer particles. After the polymer particles are colored in the manner described above, the residual dye is filtered as required.

The second solvent used in this invention is a solvent for the dye and also has the ability to swell the polymer marticles so that they are easily impregnated with the dye. Therefore, in this invention, the polymer particles are colored with the dye in a very short period of time, and the resulting color density is very high. When the polymer dispersion contains the dye but not the second solvent, it must be heated at 85+2° for as long as about 3 hours before the dye is deposited on or impregnated in the polymer particles, and only low color density is produced. In contrast, the process of this invention requires only about 10 minutes to color the polymer particles by heating at ordinary temperatures or at 85+2° C., and the color density obtained is very high.

This invention is now described in greater detail by reference to the following examples which are given here for illustrative purposes only and are by no means intended to limit the scope of the invention.

EXAMPLE 1

A solution (I) consisting of 40 ml of vinyl acetate and 0.15 g of Disperse Yellow 42 was added dropwise at 100 ml of a 15 wt% solution (II) of polyvinyl acetate latex in Isopar H under stirring. After the dropwise addition, the mixture was stirred for about 10 more minutes, and subsequently, the vinyl acetate was removed from the mixture at 50° C. under vacuum (40 mmHg) with a rotary evaporator. To the resulting colored latex dispersion, 0.06 g of calcium stearate was added, and the mixture was diluted with Isopar H to give a 30-fold dilution. When the dilution was used as a liquid developer in electrostatic photography, a very sharp image was produced. The developer had an electrical resistivity of $5\times10^{12}$ ohms/cm which was not greatly different from the value of the uncolored solution (II) ($1\times10^{13}$ ohms/cm). The colored dispersion of this invention remained entirely unchanged upon standing for 2 months and produced an image as sharp as that produced immediately after preparation.

For comparison, a liquid developer was prepared in the following manner: 0.15 g of Disperse Yellow 42 (without vinyl acetate) was added to a solution the same as solution (II), followed by stirring at 50° C. for 10 minutes. Thereafter, 0.06 g of calcium stearate was further added. The mixture was diluted with Isopar H to give a 30-fold dilution. The resulting liquid developer provided an image having poor image density. Further, it was found that a large amount of the dye was not adsorbed on the polyvinyl acetate latex and was precipitated in the liquid developer upon storage.

EXAMPLE 2

A liquid developer was prepared by repeating the procedure of Example 1 except that Disperse Yellow 42 was replaced by Disperse Red 73. When the developer was used in electrostatic photography, a dense and sharp image was produced.

EXAMPLE 3

To 100 ml of a 15 wt% solution of polyvinyl acetate latex in Isopar H, 0.15 g of Disperse Blue 5 powder was added, and 40 ml of vinyl acetate was further added under stirring. Following stirring for about 10 more minutes, the vinyl acetate was removed by drawing a vacuum with a rotary evaporator in the same manner as in Example 1. To the dispersion, 0.06 g of calcium naphthenate was added, and the mixture was diluted with Isopar H to give a 30-fold dilution which was designated a liquid developer (A). Further, liquid developers (B) and (C) were prepared by the same procedure except that the developer (B) was freed of vinyl acetate by heating at about 70° C. for 10 minutes and that the developer (C) was heated at 80° C. for 2 hours without addition of vinyl acetate. When electrostatic photography was conducted with the three developers, both developers (A) and (B) produced a sharp dense image whereas developer (C) produced a less dense image.

EXAMPLES 4 TO 11

Liquid developers were prepared by repeating the procedure of Example 1 except that Disperse Yellow 42 was replaced by the following dyes. The results were the same as obtained in Example 1.

Dyes

Disperse Red 88 (Example 4)
Disperse Blue 54 (Example 5)
Solvent Red 100 (Example 6)
Solvent Red 71 (Example 7)
Disperse Red 60 (Example 8)
Sumikaron Rubine S-2GL (Example 9)
Sumikaron Rubine SE-GL (Example 10)
Sumikaron Brilliant Red SE-BL (Example 11)

While the invention has been described in detail and with reference to specific embodiments thereof, it will be apparent to one skilled in the art that various changes and modifications can be made therein without departing from the spirit and scope thereof.

What is claimed is:

1. A process for producing a liquid developer for electrostatic photography, which comprises adding a dye in a dispersion of fine polymer particles in a non-polar solvent, said dye being insoluble in said non-polar solvent and soluble in a monomer which is at least one component of the polymer, and then coloring the polymer particles by removing from the dispersion a second solvent which dissolves the dye, is miscible with the non-polar solvent and is capable of swelling at least part of the polymer, in the presence of said second solvent in the dye-containing polymer dispersion.

2. A process according to claim 1, wherein said second solvent is made of a monomer which is the same as the monomer used as at least one component of the polymer.

3. A process according to claim 1 or 2, wherein said polymer particles are prepared by a polymerization granulation method.

4. A process according to claim 1 or 2, wherein said second solvent is present in the dispersion to which the dye is to be added.

5. A process according to claim 4, wherein said second solvent present in the dispersion to which the dye is to be added is the monomer that has been left yet to be polymerized when the polymer particles are formed by a polymerization granulation method.

6. A process according to claim 1 or 2, wherein said second solvent is added to the polymer dispersion before the addition of the dye to the dispersion.

7. A process according to claim 3, wherein said second solvent is present in the dispersion to which the dye is to be added.

8. A process according to claim 1 or 2, wherein said second solvent is added to the polymer dispersion after the addition of the dye to the dispersion.

9. A process according to claim 1 or 2, wherein said second solvent is added to the polymer dispersion simultaneously with the addition of the dye to the dispersion.

10. A process according to claim 1 or 2, wherein said dye is added in an amount of at least 0.5 wt% of the polymer particles in the dispersion.

11. A process according to claim 1 or 2, wherein the amount of said second solvent is from a tenth of to ten times the weight of the polymer particles in the dispersion before said removal of the second solvent.

12. A liquid developer for electrostatic photography produced by a process comprising adding a dye in a dispersion of fine polymer particles in a non-polar solvent, said dye being insoluble in said non-polar solvent and soluble in a monomer which is at least one component of the polymer, and then coloring the polymer particles by removing from the dispersion a second solvent which dissolves the dye, is miscible with the non-polar solvent and is capable of swelling at least part of the polymer, in the presence for said second solvent in the dye-containing polymer dispersion.

* * * * *